US010494811B1

(12) United States Patent
Gussenbauer et al.

(10) Patent No.: US 10,494,811 B1
(45) Date of Patent: Dec. 3, 2019

(54) EXPANDABLE WALL START FOR A MOVABLE WALL

(71) Applicant: Haworth, Inc., Holland, MI (US)

(72) Inventors: Leah R. Gussenbauer, Grand Rapids, MI (US); Nathaniel S. Shedd, Calgary (CA); Daniel M. Van Huis, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 16/124,346

(22) Filed: Sep. 7, 2018

(51) Int. Cl.
*E04B 2/82* (2006.01)

(52) U.S. Cl.
CPC ..... *E04B 2/828* (2013.01)

(58) Field of Classification Search
CPC ..... E04B 2/828
See application file for complete search history.

(56) References Cited

U.S. PATENT DOCUMENTS 8,024,901 B2 * 9/2011 Gosling ..... E04B 2/7424 52/238.1
9,249,567 B2 * 2/2016 Yu ..... E04C 2/521
9,650,785 B2 * 5/2017 Yu ..... E04C 2/521
9,879,420 B2 * 1/2018 Joseph ..... E04B 2/7401
9,903,112 B2 * 2/2018 Lanwehr ..... E04B 2/825
RE46,929 E * 7/2018 Gosling ..... E04B 2/7433
RE47,132 E * 11/2018 Gosling ..... E04B 2/7433
2013/0025220 A1 * 1/2013 Yu ..... E04C 2/52 52/220.7
2016/0160500 A1 * 6/2016 Yu ..... E04C 2/521 52/243.1

OTHER PUBLICATIONS

Lightline Architectural Wall Assembly Instructions, Sep. 2017.
Lightline Wall Statement of Line, Jan. 2015.

* cited by examiner

*Primary Examiner* — Andrew J Triggs
(74) *Attorney, Agent, or Firm* — Warner Norcross + Judd LLP

(57) ABSTRACT

An expandable wall start for attaching a movable wall to an end face of an existing structural wall. The wall start includes a pair of clips and a pair of cladding rails. Each clip includes a first fastener portion configured to attach to the movable wall and a second fastener portion including ratchet teeth. The cladding rails are configured to cover at least a portion of the end face of the structural wall. Each rail includes a first leg and a second leg; the first leg includes ratchet teeth on an interior surface. The first leg of each cladding rail is received within the second fastener portion of each clip, and the ratchet teeth of each first leg are configured to engage the ratchet teeth of the second fastener portion of each clip. The wall start is expandable to accommodate structural walls having different widths.

20 Claims, 7 Drawing Sheets

EXPANDABLE WALL START FOR A MOVABLE WALL

BACKGROUND OF THE INVENTION

The present invention relates to movable wall systems, and more particularly to an expandable wall start for connecting a movable wall to an existing structural wall.

Commercial buildings typically include large open office areas which are divided into smaller work spaces or workstations by any of a number of space divider and panel systems. These space divider arrangements typically use upright space-dividing wall panels which serially connect together to subdivide the office area into multiple smaller workstations of desired size and configuration. These space-dividing wall panel systems may be preferable in many cases over "hard" or permanent architectural walls typically built of studs and drywall because they are typically reconfigurable. Movable wall panel systems achieve substantially the same result of subdividing a building space, while also providing flexibility in being able to disassemble and move the walls when reconfiguring the building space.

Securing wall panels to the existing architectural walls is generally a long and tedious job that often entails using fasteners such as nails and/or screws to mount the wall panels directly to the finished architectural walls. The fasteners are typically exposed and detract from the general appearance of the building.

Other wall panel systems utilize an attachment mechanism, commonly referred to as a "wall start," for attaching the first in a series of movable wall panels to the finished surface of the existing architectural wall. Typically, the side edge of the movable wall panel is positioned a distance away from the architectural wall and uses an interface piece, such as a bracket, to connect the movable wall panel to the architectural wall. The interface piece is mounted to the movable wall panel, but does not integrate the visual appearance of the movable wall and the existing wall, and provides an abrupt transition.

SUMMARY OF THE INVENTION

The present invention provides an expandable wall start for attaching a movable wall to an end face of an existing structural wall. The wall start may include a pair of clips and a pair of cladding rails. Each clip may include a first fastener portion configured to attach to the movable wall and a second fastener portion including ratchet teeth. The cladding rails may be configured to cover at least a portion of the end face of the structural wall. Each rail may include a first leg and a second leg; the first leg may include ratchet teeth on an interior surface. The first leg of each cladding rail may be received within the second fastener portion of each clip, and the ratchet teeth of each first leg may be configured to engage the ratchet teeth of the second fastener portion of each clip. The wall start is expandable to accommodate structural walls having different widths.

In another embodiment, the first leg of each cladding rail may be inserted into the respective clip a distance such that the ratchet teeth of the cladding rail engage the ratchet teeth of the clip. The distance that the first leg is inserted into the clip is adjustable for attaching the wall start to structural walls having different widths. Further, one of the first legs of the pair of cladding rails may be inserted into the clip a first distance, and the other of the first legs of the pair of cladding rails may be inserted into the other of the pair of clips a second distance. The first distance and the second distance may be unequal so that the attached movable wall may be off-center with respect to the width of the end face of the structural wall.

Figure 1:
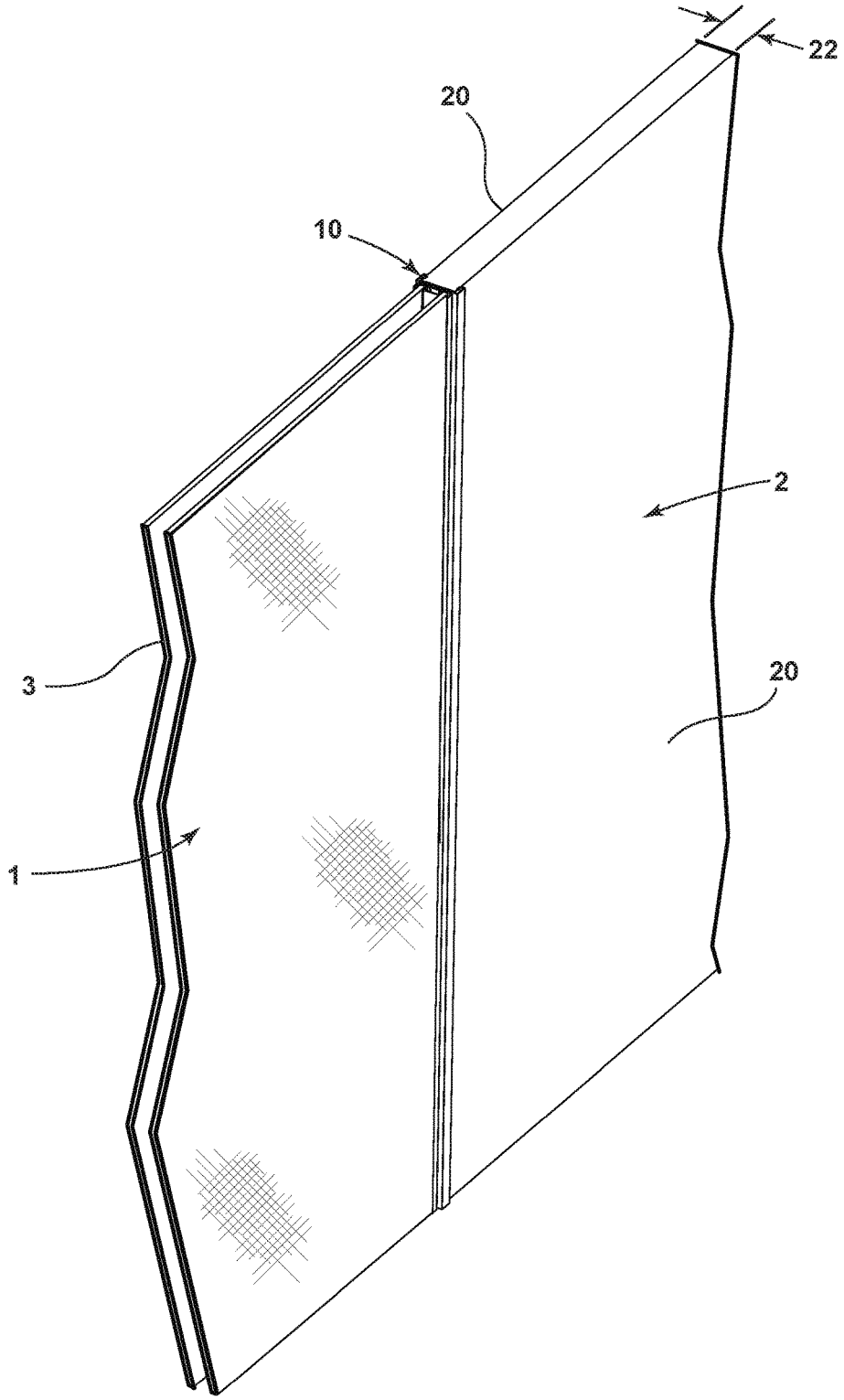
FIG. 1 is a perspective view of a moveable wall connected to an existing structural wall by a wall start according to an embodiment of the invention.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. The words "proximal" and "distal" will refer to the orientation of an element with respect to the device. Such terminology will include derivatives and words of similar import.

DETAILED DESCRIPTION OF THE CURRENT EMBODIMENTS

An expandable wall start for attaching a movable wall 1 to an end face of an existing structural wall 2 in accordance with an embodiment of the present invention is illustrated in the drawings and designated 10. In general, the invention relates to traditional space-dividing wall systems that include multiple wall panels 3 that can be readily positioned and sized to define a variety of configurations to create individual building spaces or functional spaces in an open building area. More particularly, the movable wall 1 is attached to the structural wall 2 with the wall start 10 which is expandable and adjustable to accommodate a range of existing structural wall thicknesses and to cover the end face of the structural wall.

Figure 2:
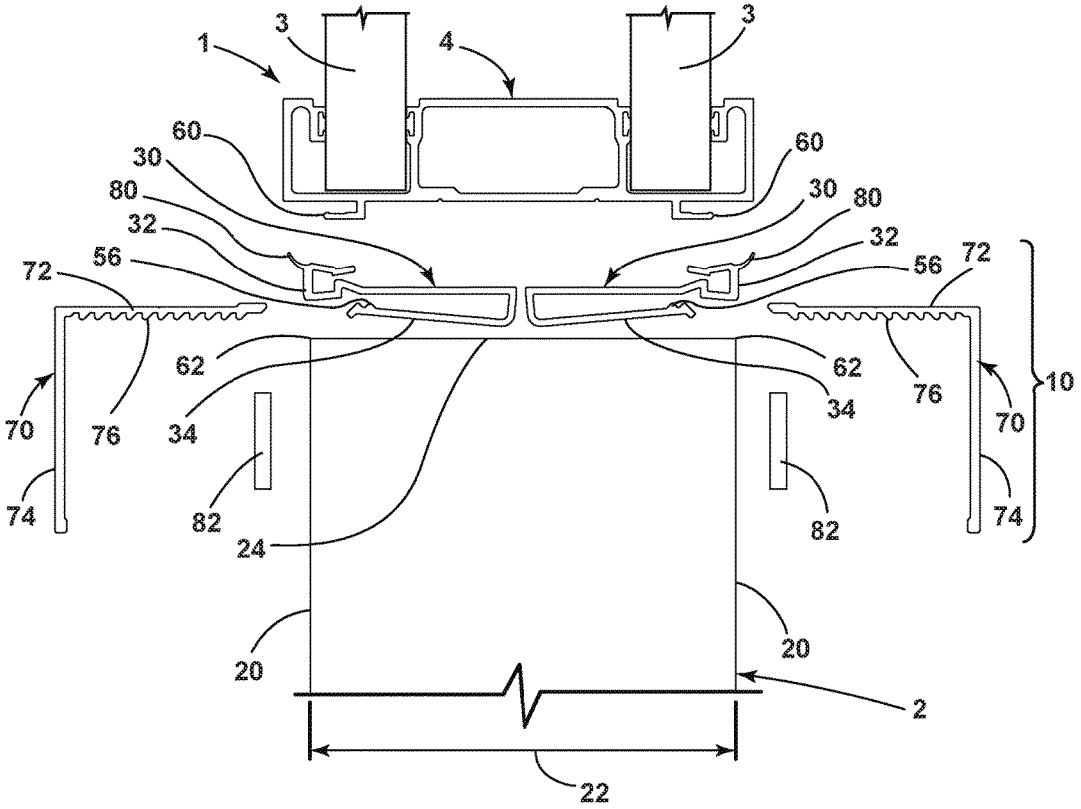
FIG. 2 is an exploded top view of an end rail of the moveable wall, the structural wall, and the wall start of FIG. 1.

Generally, the wall panel 3 has a first side edge that includes an end rail 4 (FIG. 2) that is aligned adjacent an existing, finished structural wall 2 of the building. The wall panel 3 also includes an opposite side edge (not shown) that can be connected to another wall panel 3. These wall panels 3 serially connect, for example, in two-panel straight or angled, or three- or four-panel corner configurations so as to subdivide an office area into the separate work spaces. The wall panels 3 generally include cover panels or sheets, or fabric that provide an aesthetic, finished appearance.

The structural wall 2 is conventional and can be a "hard" or permanent architectural wall typically built of studs and drywall. The structural wall 2 has opposed wall surfaces 20 that have a length and a height and define a width 22 therebetween. The structural wall 2 terminates in an end face 24 (FIG. 2) is defined by the width 22 and the height of the wall 2.

Referring to FIGS. 2-7, the expandable wall start 10 includes a clip 30 and a pair of cladding rails 70. The clip 30 is configured to attach to the movable wall 1, and more specifically to attach the end rail 4 of the movable wall 1. The clip 30 may be a single component, or may be provided as two substantially similar clips 30 arranged in mirror image relationship relative to one another. The clip 30 is an elongated, irregularly shaped member that may extend, for example, the height of the movable wall 1. Of course, the clip 30 could be shorter.

Figure 3:
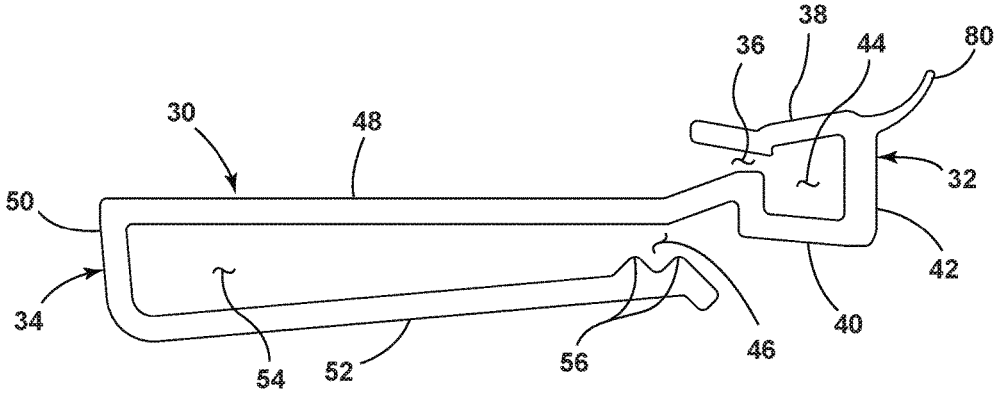
FIG. 3 is a top view of a clip of the wall start.

The clip 30 includes a first fastener portion 32 and a second fastener portion 34, as best seen in FIG. 3. The first fastener portion 32 is configured to attach or mount to the end rail 4 of the moveable wall 1. The first fastener portion 32 may be in the form of a spring clip having a slot 36, opposed side walls 38, 40, and a rear wall 42, the walls enclosing an interior chamber 44. The second fastener portion 34 may also be in the form of an elongated spring clip having an opening 46, a base wall 48, a rear wall 50, and a spring leg 52, the walls enclosing an interior chamber 54. Additionally, an interior surface of the spring leg 52 includes one or more ratchet teeth 56. The ratchet teeth 56 are disposed on the spring leg 52 adjacent the opening 46 of the second fastener portion 34.

The clip 30 is configured to attach to the movable wall 1. More specifically, the clip 30 is configured to receive a tab 60 of the moveable wall end rail 4. The slot 36 of the first fastener portion 32 is inserted over/onto the tab 60 of the end rail 4. The clamping force provided by the first fastener portion 32 retains the clip 30 on the end rail 4. Other means of attaching the first fastener portion to the end rail 4 are also contemplated herein; for example, fasteners such as Christmas tree type fasteners, expansion clips, and other fasteners suitable for mounting the clip 30 to the end rail 4 are feasible.

The cladding rail 70 is an elongated member that may extend, for example, the height of the movable wall 1. The cladding rail 70 includes a first leg 72 and a second leg 74, the legs being arranged substantially perpendicular to one another. The first leg 72 includes ratchet teeth 76 disposed on an interior surface of the first leg 72, and the row of ratchet teeth 76 may extend along a majority of the length of the first leg 72. The cladding rail 70 may be made of aluminum, plastic, or any other suitable material and may be provided in a variety of finishes. The finish and size of the cladding rail is designed to provide a visually consistent look with the moveable wall 1 and its components. Further, the cladding rail 70 may be provided in a variety of sizes and may be notched to support interfaces with irregular building architecture, such as window mullions and window sills.

Figure 5:
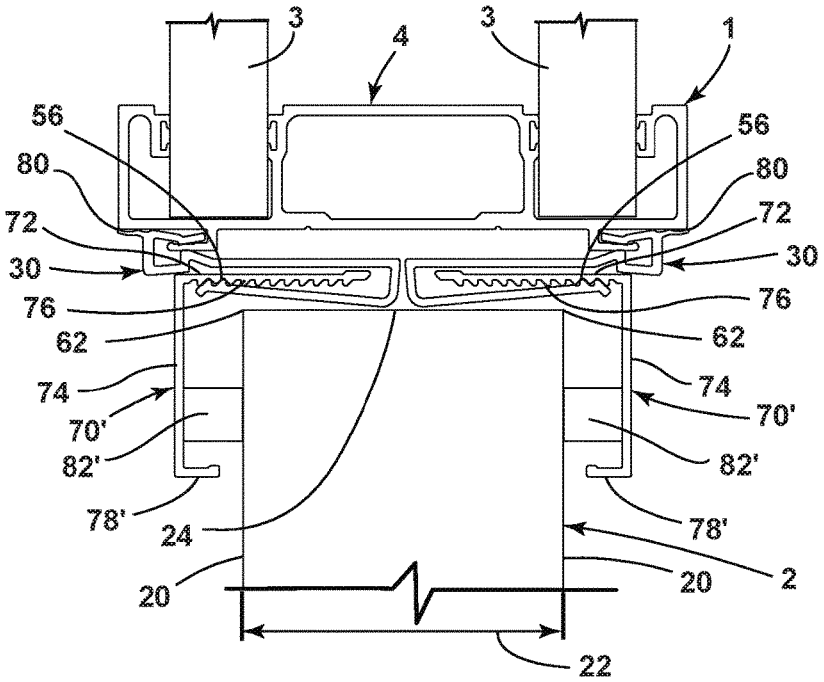
FIG. 5 is a top view of the movable wall, the wall start, the structural wall, and narrow cladding rails, illustrating use of the wall start with a thin structural wall.

As illustrated in FIG. 5, the wall start 10 may include an alternate, narrow cladding rail 70'. The narrow cladding rail 70' is similar to the standard cladding rail 70, but includes a flange 78' that extends from the second leg 74' toward the wall surface 20. The narrow cladding rail 70' and its flange 78' allow the wall start 10 to be used with narrow structural walls, while providing a facade or concealing the gap between the narrow cladding rail 70' and the structural wall 20. Additionally, a thicker foam 82' can be included with the narrow cladding rail 70' to accommodate the greater gap between the narrow cladding rail 70' and the structural wall 20. Other than the noted differences, the narrow cladding rail 70' is substantially the same in structure and installation as described herein with respect to the standard cladding rail 70. Unless otherwise noted, the description herein is considered to refer to both or either cladding rail.

As installed, the cladding rail 70 is configured to cover at least a portion of the end face 24 of the structural wall 2. For example, the pair of cladding rails 70 may be configured to cover corners 62 of the structural wall 2 that are formed between the end face 24 and the wall surfaces 20. The first leg 72 of each rail 70 is disposed substantially parallel to the end face 24 and the second leg 74 of each rail is disposed substantially parallel to one of the wall surfaces 20. The ratchet teeth 76 of the cladding rail 70 are configured to engage the ratchet teeth 56 of the clip 30. In addition, the cladding rail 70, which covers the end face 24 of the structural wall 2, allows the end face 24 of the structural wall 2 to remain unfinished and raw.

The first leg 72 of the cladding rail 70 may be inserted into the clip 30 and the ratchet teeth 76 of the cladding rail 70 engage with the ratchet teeth 56 of the clip 30. The exterior surface of the first leg 72 contacts the side wall 40 of the clip 30. The interaction between the ratchet teeth 56, 76, the contact between the first leg 72 and the side wall 40, and the contact between the second leg 74 and the wall surface 20 keeps the cladding rail 70 properly aligned and retained between the structural wall 2 and the clip 30.

The clip 30 may include a flexible gasket 80 disposed on an exterior surface of the rear wall 42. The gasket 80 is a pliable material and is configured to contact the movable wall 1 to mask or cover the junction between the clip 30 and the movable wall 2. The gasket 80 provides improved aesthetics and masks any gap that may exist between the components.

The wall start 10 may also include a compressible material, such as foam 82 or fiberglass insulation, positioned between the second leg 74 of the cladding rail 70 and the wall surface 20 of the structural wall 2. The foam 82 may be attached to the interior of the second leg 74 and provides an acoustic seal, or at least a reduction in sound transmission, between the cladding rail 70 and the existing structural wall 2.

A description of the clip 30 and cladding rail 70 is provided above. The second clip and the second cladding rail are substantially the same as described above with respect to the clip 30 and the cladding rail 70. As illustrated in the drawings, the clips are substantially mirror image relative to one another, and the rails are also substantially mirror image relative to one another.

The wall start 10 provides a means for starting a moveable wall system from the end face 24 of a structural wall 2. To install the wall start 10, the two clips 30 and 30 are inserted onto the respective tabs 60 of the movable wall end rail 4, so that the tabs 60 extend through the slot 36 of the first fastener portion 32. The movable wall 1 and clips 30 are moved into position adjacent the end face 24 of the structural wall 2, and the two cladding rails 70 are installed by inserting the first leg 72 of each rail into the opening 46 of the second fastener portion 34 of the respective clip 30. When inserting the cladding rail 70 into the clip 30, the ratchet teeth 56, 76 of the components engage, retaining the clip 30 and cladding rail 70 in position. Notably, together, the cladding rails 70, clips 30, and end rail 4 enclose the entire end face 24 of the structural wall 2. This provides an aesthetically pleasing finish to the end of the structural wall 2, which therefore does not need to be properly finished by the builder or other personnel.

As illustrated in FIGS. 4-7, the wall start 10 is expandable and capable of accommodating structural walls 2 of different widths. The first leg 72 of each cladding rail 70 is inserted into the respective clip 30 a selectable depth or distance. This distance is adjustable and increases or decreases when installed over wider or narrower existing structural walls 2. The first leg 72 is inserted into the second fastener portion 34 of the clip 30 until the second leg 74 (and/or foam 82) contacts the wall surface 20. The row of ratchet teeth 76 on the cladding rail 70 ensure that regardless of the insertion distance, the ratchet teeth 76 will engage the ratchet teeth 56 of the clip 30.

Further, the thickness of the foam 82 disposed between the structural wall 2 and the cladding rail 70 can be selected to accommodate a thicker or thinner structural wall 2. As seen in FIG. 5, a relatively thick strip of foam 82 is used with the relatively thin structural wall 2. The thickness of the structural wall 2, the thickness of the foam 82, 82', the selected standard or narrow cladding rails 70, 70', and the distance at which the cladding rail 70 is inserted into the clip 30 may all be varied as desired to accommodate a variety of situations.

Figure 4:
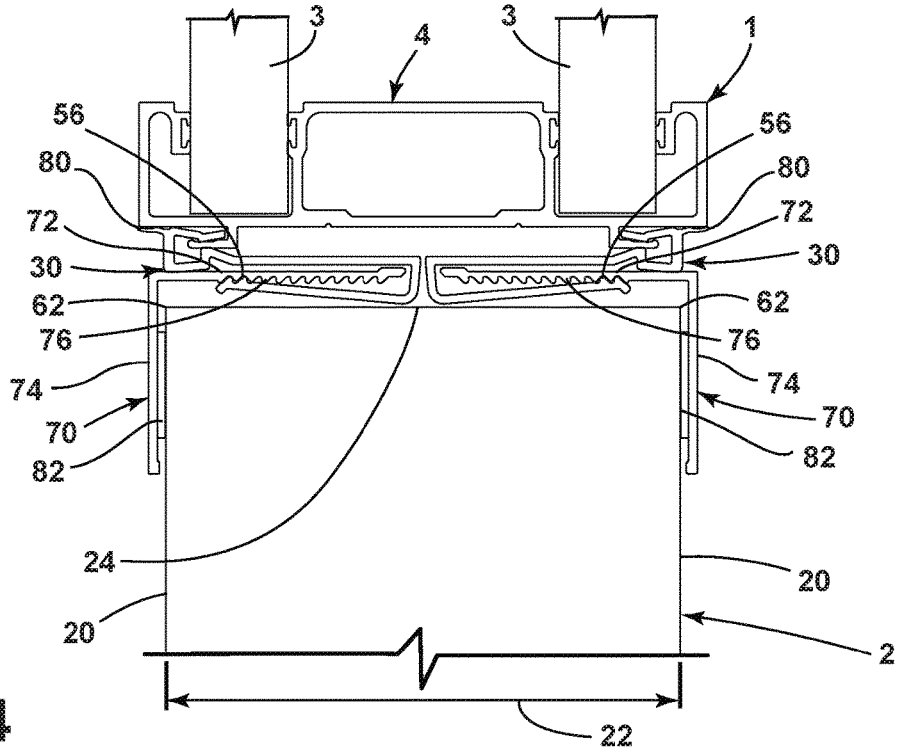
FIG. 4 is a top view of the movable wall, the wall start, the structural wall, and standard cladding rails, illustrating use of the wall start with a structural wall.
Figure 6:
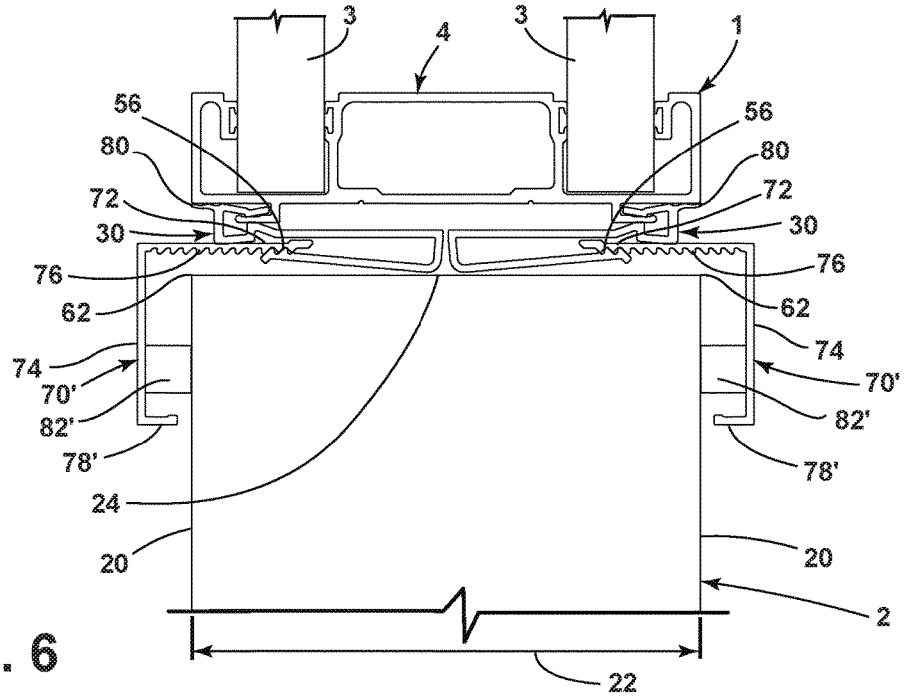
FIG. 6 is a top view of the movable wall, the wall start, the structural wall, and narrow cladding rails, illustrating use of the wall start with a thicker structural wall.
Figure 7:
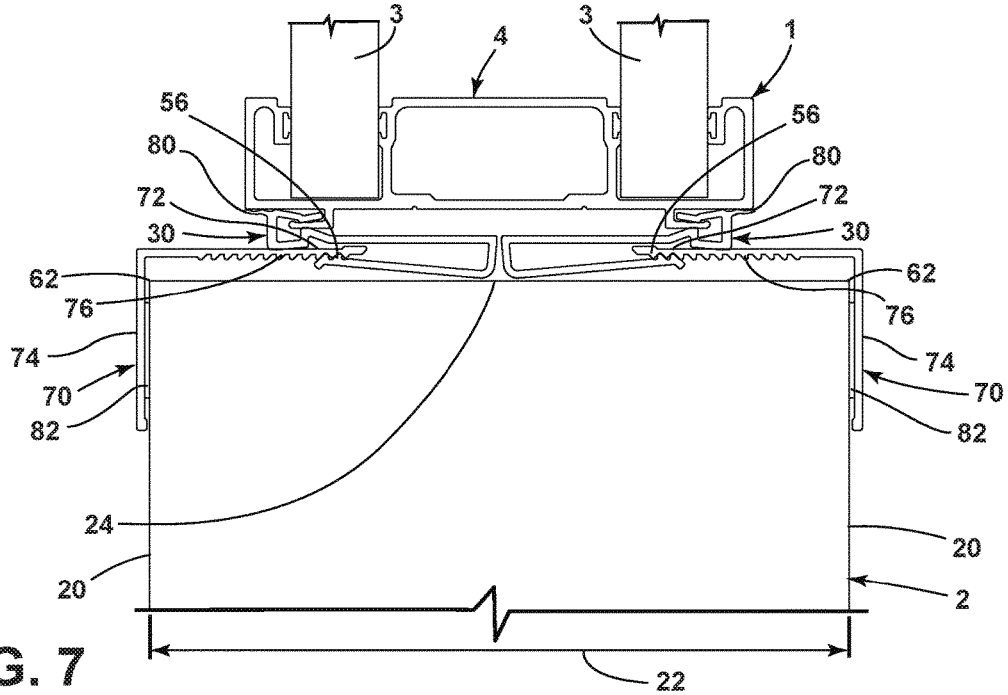
FIG. 7 is a top view of the movable wall, the wall start, the structural wall, and standard cladding rails, illustrating use of the wall start with a thicker structural wall.

As an example, the wall start 10 illustrated in FIG. 4 shows a "standard" width structural wall 2 in combination with the standard cladding rails 70 and foam 82. The wall start 10 illustrated in FIG. 5 enables the wall start 10 to be used with a narrow structural wall 2 in combination with the narrow cladding rails 70' and thick foam 82'. The wall start 10 illustrated in FIG. 6 shows somewhat thicker width structural wall 2 in combination with the narrow cladding rails 70' and thick foam 82'. Lastly, wall start 10 illustrated in FIG. 7 shows a wide structural wall 2 in combination with the standard cladding rails 70 and foam 82, the cladding rails extended to their maximum width.

Figure 8:
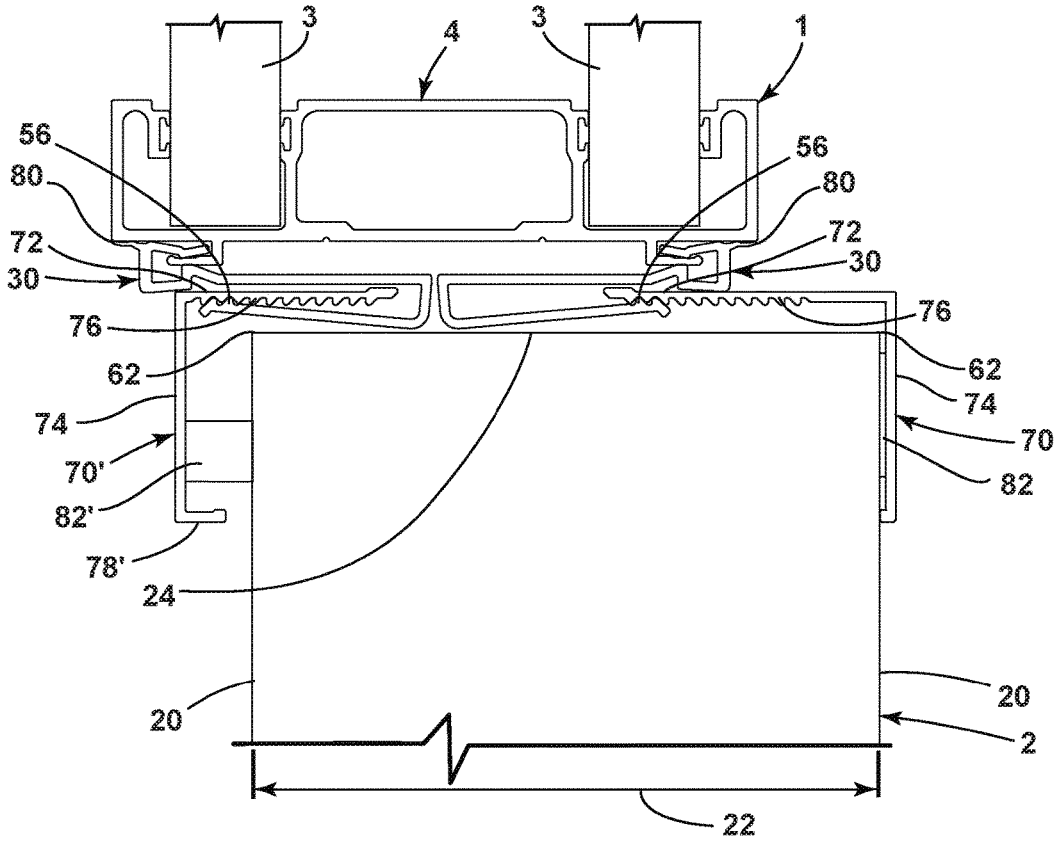
FIG. 8 is a top view of the movable wall, the wall start, and the structural wall, illustrating the wall start and moveable wall positioned off-center relative to the structural wall and including both standard and narrow cladding rails.

Referring to FIG. 8, additionally, the two cladding rails 70 can be inserted into the clips 30 at different distances, so that the wall start 10 (and moveable wall 1) is off-center relative to the width of the end face 24 of the structural wall 2. For example, if the first leg 72 of the first cladding rail 70 is inserted a distance X, and the first leg 72 of the second cladding rail 70 is inserted a distance greater than X, the wall start 10 and the movable wall 1 will be displaced toward the second cladding rail 70.

Figure 9:
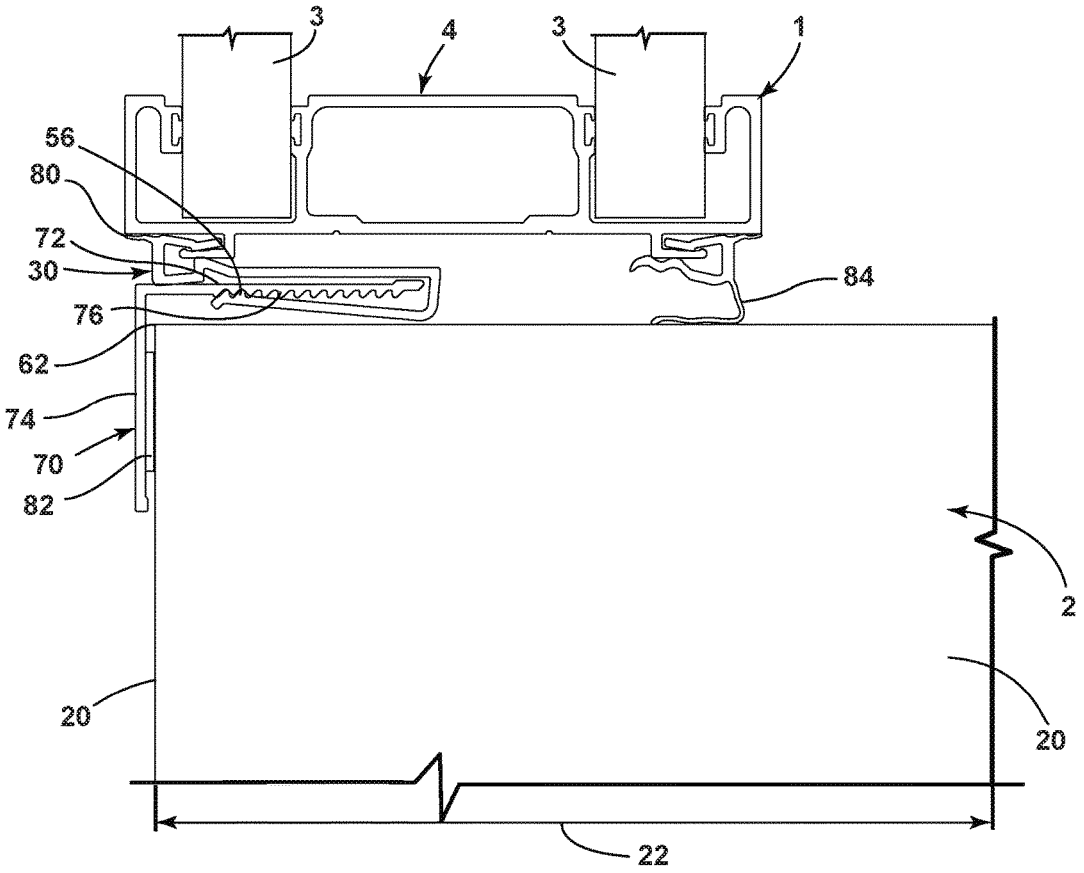
FIG. 9 is a top view of the movable wall, an alternate wall start, the structural wall, and a gasket clip.

Referring to FIG. 9, alternatively, the wall start 10 may include only one clip 30 and one cladding rail 70. The remaining side of the structural wall may be closed off with a gasket clip 84 that functions similar to that of the aforementioned gasket 80. The gasket clip 84 can be inserted over the tab 60 of the end rail 4, similar to how the clip 30 is installed. Further, the wall start 10 may be applied to a corner 62 of the structural wall, and is not limited to covering the end face 24. In this arrangement, the wall start 10 connects to two perpendicular structural wall surfaces that include an external corner therebetween. The example shown in FIG. 9 includes the clip and cladding rail attached to the left side of the end rail, and the gasket clip mounted to the right side of the end rail; however, it should be readily understood that the clip and cladding rail could be switched with the gasket clip to cover the opposite corner of the structural wall.

Figure 10:
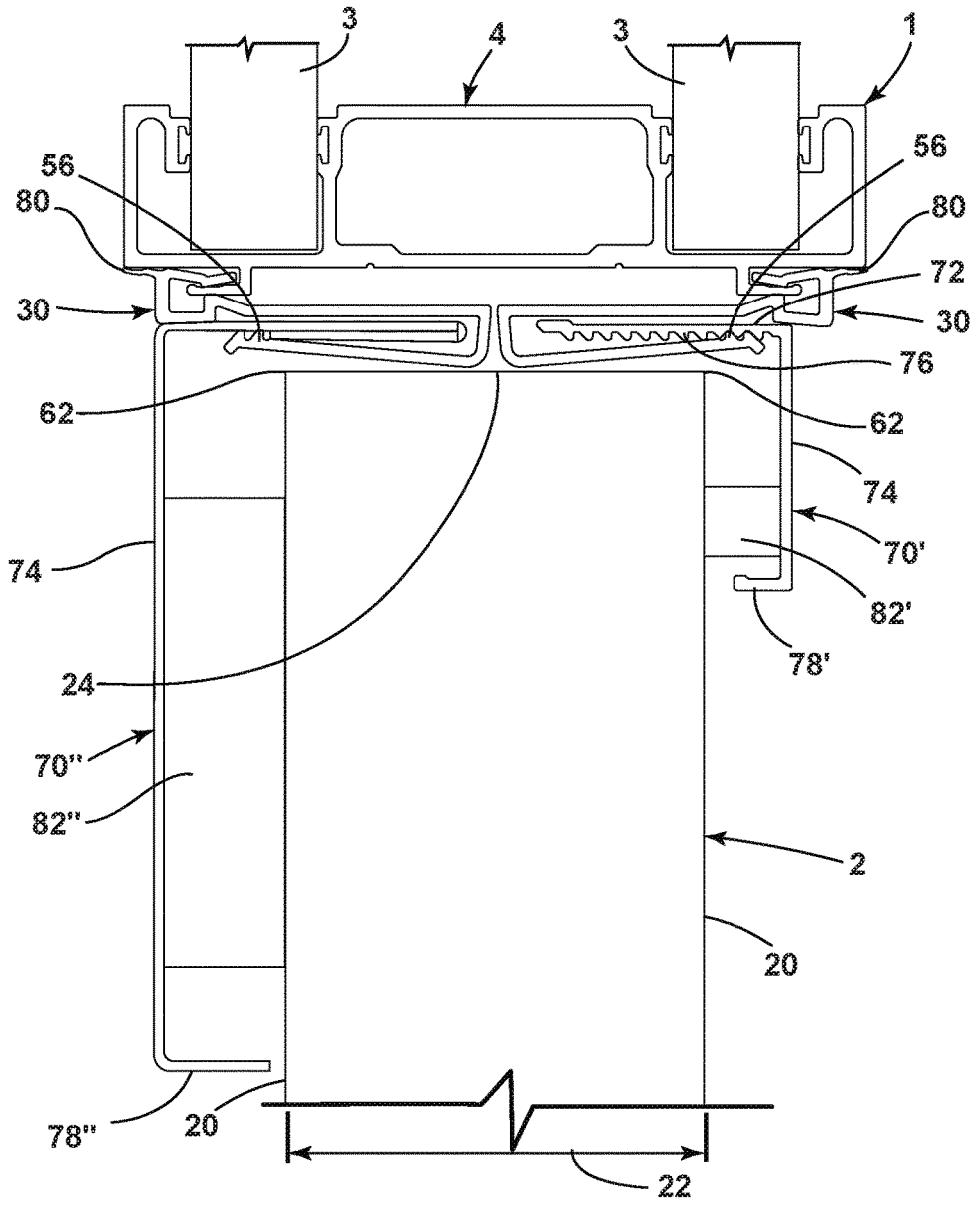
FIG. 10 is a top view of the movable wall, an alternate wall start including a custom cladding rail, and the structural wall.

Referring to FIG. 10, the wall start 10 may include a custom cladding rail 70". This custom cladding rail 70" can be custom formed out of sheet aluminum or other suitable material, for applications where the standard or narrow cladding rails do not work.

Alternatively, the wall start 10 may include one clip 30 and one cladding rail 70 to cover one corner of the structural wall 2. The second corner may be covered by an alternate cladding rail that is mounted directly to the end rail 4, thereby eliminating the second clip 30 used in embodiments described heretofore. Accordingly, adjustability for the alternate wall start is accomplished by the one clip 30 and one cladding rail 70.

The wall start 10 described herein provides a connection between a moveable wall 1 and an existing structural wall 2 and integrates the visual appearance of the two walls. The finishes and size of the cladding rails 70 and clips 30 are designed to provide a visually consistent look with wall panel systems. In addition to the visual interface, the finished cladding rail covers the end of the existing structural wall end face 24, which allows the end face 24 to remain unfinished and raw. In addition, the interface between the cladding rails and the clips is adjustable, accommodating a range of existing structural wall widths.

The above description is that of the current embodiment of the invention. Various alterations and changes can be made without departing from the spirit and broader aspects of the invention.

The invention claimed is:

1. An expandable wall start for attaching a movable wall to an end face of an existing structural wall, the wall start comprising:

a pair of clips, each clip comprising a first fastener portion configured to attach to the movable wall and a second fastener portion including ratchet teeth; and a pair of cladding rails configured to cover at least a portion of the end face of the structural wall, each rail comprising a first leg and a second leg, the first leg including ratchet teeth on an interior surface thereof, wherein the first leg of each cladding rail is received within the second fastener portion of each clip, and the ratchet teeth of each first leg are configured to engage the ratchet teeth of the second fastener portion of each clip, wherein the wall start is expandable to accommodate structural walls having different widths.

2. The expandable wall start of claim 1, each clip including a flexible gasket disposed on an exterior thereof, the gasket configured to contact the movable wall and cover a junction between the clip and the movable wall.

3. The expandable wall start of claim 1 wherein the structural wall defines opposing surfaces and a width therebetween, the structural wall terminating in the end face defined by the width, and the wall start encloses the end face.

4. The expandable wall start of claim 3 wherein the first and second legs of each cladding rail are arranged substantially perpendicular to one another, the first leg extending along at least a portion of the end face, and the second leg extending along at least a portion of the surface of the structural wall.

5. The expandable wall start of claim 4 wherein the clips are arranged in mirror image relationship.

6. The expandable wall start of claim 4 including a compressible material positioned between the second leg of each cladding rail and the surface of the structural wall.

7. The expandable wall start of claim 1 wherein the first leg of each cladding rail is received within the second fastener portion of the complementary clip, and a depth at which the first leg is received within the second fastener portion is adjustable to accommodate structural walls having different widths.

8. An expandable wall start for attaching a movable wall to an existing structural wall, the wall start comprising:

a clip configured to attach to the movable wall, the clip including ratchet teeth; and a first cladding rail configured to cover a corner formed between first and second surfaces of the structural wall, the first rail comprising a first leg disposed substantially parallel to the first surface and a second leg disposed substantially parallel to the second surface, the first leg including ratchet teeth, wherein the first leg of the first cladding rail is inserted into the clip and the ratchet teeth of the first cladding rail engage with the ratchet teeth of the clip such that the wall start attaches the movable wall to the existing structural wall and covers the corner of the structural wall.

9. The wall start of claim 8 including a compressible material positioned between the second leg of the first cladding rail and the second surface of the structural wall.

10. The wall start of claim 8 wherein the ratchet teeth of the clip and first cladding rail engage at any depth at which the first leg is inserted into the clip, whereby the wall start is adjustable for attaching to structural walls of differing dimensions.

11. The wall start of claim 8 including a flexible gasket configured to attach to the movable wall and cover a junction between the structural wall and the movable wall.

12. The wall start of claim 8 including a second cladding rail configured to cover a second corner formed between the first surface of the structural wall and a third surface of the structural wall, the second rail comprising a first leg disposed substantially parallel to the first surface and a second leg disposed substantially parallel to the third surface.

13. The wall start of claim 12 wherein the clip comprises a pair of mirror image clips.

14. The wall start of claim 13 wherein one of the first legs of the first and second cladding rails is inserted into the clip at a first depth, and the other of the first legs of the first and second cladding rails is inserted into the clip at a second depth.

15. The wall start of claim 14 wherein the first depth and the second depth are substantially equal.

16. The wall start of claim 14 wherein the first depth and the second depth are not equal, therefore the attached movable wall is not centered between the first and third surfaces of the structural wall.

17. An expandable wall start for attaching a movable wall to an existing structural wall, the structural wall having opposed surfaces and a width therebetween, the structural wall terminating in an end face defined by the width, the wall start comprising:

a pair of clips, each clip configured to attach to the movable wall and including ratchet teeth; and a pair of cladding rails configured to cover corners formed between the end face and the surfaces the structural wall, each cladding rail comprising a first leg disposed adjacent the end face and a second leg disposed adjacent the surface of the structural wall, the first leg including ratchet teeth, wherein the first leg of each cladding rail is inserted into the respective clip a distance such that the ratchet teeth of the cladding rail engage the ratchet teeth of the clip, wherein the distance that the first leg is inserted into the clip is adjustable for attaching the wall start to structural walls having different widths.

18. The expandable wall start of claim 17 including a compressible material positioned between the second leg of each cladding rail and the surface of the structural wall.

19. The expandable wall start of claim 17 wherein one of the first legs of the pair of cladding rails is inserted into the clip a first distance, and the other of the first legs of the pair of cladding rails is inserted into the other of the pair of clips a second distance.

20. The expandable wall start of claim 19 wherein the first distance and the second distance are not equal and the attached movable wall is off-center with respect to the width of the end face of the structural wall.

* * * * *